US005171199A

United States Patent [19]

Panagos

[11] Patent Number: 5,171,199

[45] Date of Patent: Dec. 15, 1992

[54] INTERLOCKING DUMBBELLS

[76] Inventor: George C. Panagos, P.O. Box 1342, New Smyrna Beach, Fla. 32170-1342

[21] Appl. No.: 608,725

[22] Filed: Nov. 5, 1990

Related U.S. Application Data

[63] Continuation-in-part of Ser. No. 591,404, Oct. 1, 1990, Pat. No. 5,131,898.

[51] Int. Cl.[5] ..... A63B 21/075

[52] U.S. Cl. ..... 482/106; 482/107; 482/108

[58] Field of Search ..... 272/122, 123; 482/104, 482/106, 107, 108

[56] References Cited

U.S. PATENT DOCUMENTS

| | | | |
|---|---|---|---|
| 1,536,048 | 5/1925 | Alastalo | 272/122 |
| 4,361,324 | 11/1982 | Baroi | 272/122 X |
| 4,566,690 | 1/1986 | Schook | 272/122 X |
| 4,722,523 | 2/1988 | Yang | 272/122 |
| 4,913,422 | 4/1990 | Elmore et al. | 272/123 |

FOREIGN PATENT DOCUMENTS

| | | | |
|---|---|---|---|
| 1367978 | 1/1988 | U.S.S.R. | 272/122 |

*Primary Examiner*—Richard J. Apley
*Assistant Examiner*—D. F. Crosby

[57] ABSTRACT

An exercise device which is designed for connecting it to identical exercise devices. The exercise device is a dumbbell with a pair of solid single dumbbell weights securely mounted on each end of an axially extending short handle. There are two male connectors and two female connectors for connecting the dumbbell to another dumbbell vertically for doing some types of weightlifting exercises, and there is another female connector positioned on each dumbbell to connect to the opposite ends of an independent, intermediate short handle horizontally for doing barbell type exercises. The connection of two exercise devices is maintained by holding the exercise devices together with two hands while gripping the short handles of the exercise devices. Includes is a corresponding weight training method.

1 Claim, 1 Drawing Sheet

INTERLOCKING DUMBBELLS

This is a continuation-in-part of application Ser. No. 07/591/404 filed Oct. 1, 1990, now U.S. Pat. No. 5,131,898.

BACKGROUND OF THE INVENTION

1. Field of the Invention

This application relates to dumbbell and barbell weight training and exercise equipment and more particularly to solid dumbbells with interlocking connectors as well as corresponding weight training methods which allow a weightlifter to use solid dumbbells while they are connected.

2. Description of the Related Art

U.S. Pat. No. 1,536,048 to Alastalo, U.S. Pat. No. 4,361,324 to Baroi, U.S. Pat. No. 4,722,523 to Yang all describe how to combine and connect various exercise devices. However, the main focus of the references cited, is in describing the use of add-on weights. Although add-on weights such as weight plates and discs, etc. and their adaptation to barbells and dumbbells have long been a part of the weightlifting and exercise equipment inventory, their use has never gone to the extent of either excluding or replacing the solid dumbbell as the equipment of choice by weightlifters in general for a variety of weightlifting exercises. The prior art does not formally address the need for connecting and combining solid dumbbells together.

SUMMARY OF THE INVENTION

Therefore, in order to meet this need, the present invention is a dumbbell comprising a pair of solid single dumbbell weights mounted on each end of an axially extending short handle. The dumbbell has two small male connectors and two small female connectors for connecting two identical dumbbells together vertically. The dumbbell also has another small female connector which connects it to an independent, intermediate short handle for connecting two dumbbells together horizontally for use as a barbell. The connection of two identical dumbbells is engaged and maintained by holding the connected dumbbells together with two hands while gripping the short handles of the dumbbells. Included is a corresponding weight training method wherein a weightlifter, using two hands grasps two dumbbells, one in each hand and holds the dumbbells together in connected fashion and successively lifts the dumbbells maintaining them in connected fashion. The purpose of this invention is to enable a weightlifter to do barbell exercises and dumbbell exercises while using the same exercise device.

DESCRIPTION OF THE PREFERRED EMBODIMENT

Figure 1:
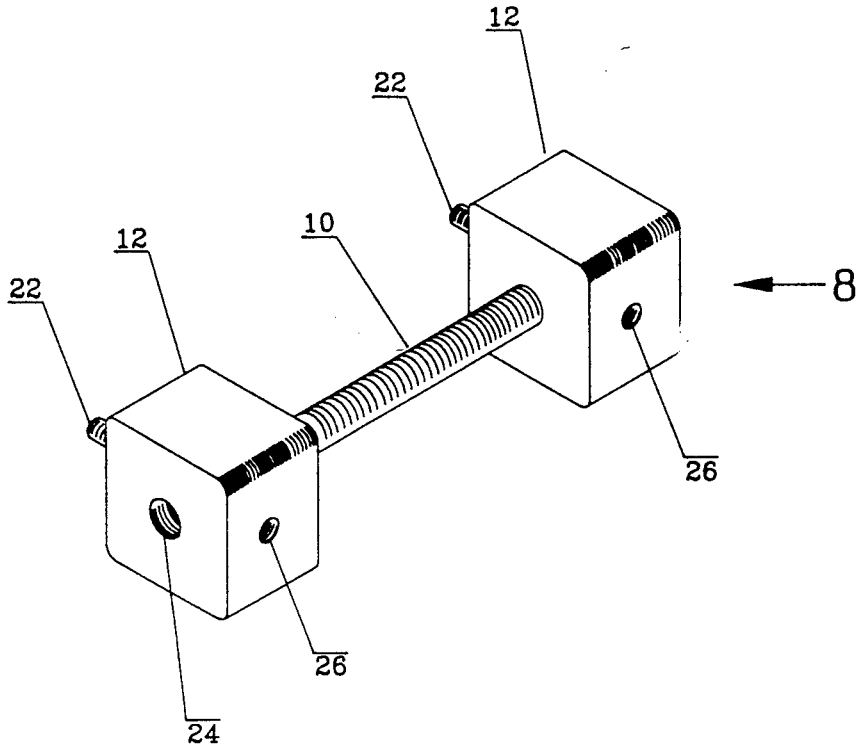
FIG. 1 is a three dimensional view showing the weighted ends and short handle of an interlocking dumbbell. Also depicted are two radially projecting male connectors and two radially recessed female connectors. An axially recessed female connector is also visible.
Figure 2:
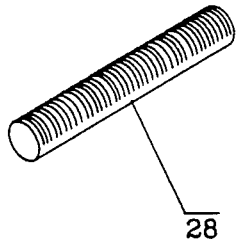
FIG. 2 is an independent, intermediate short handle in three dimensional view.
Figure 3:
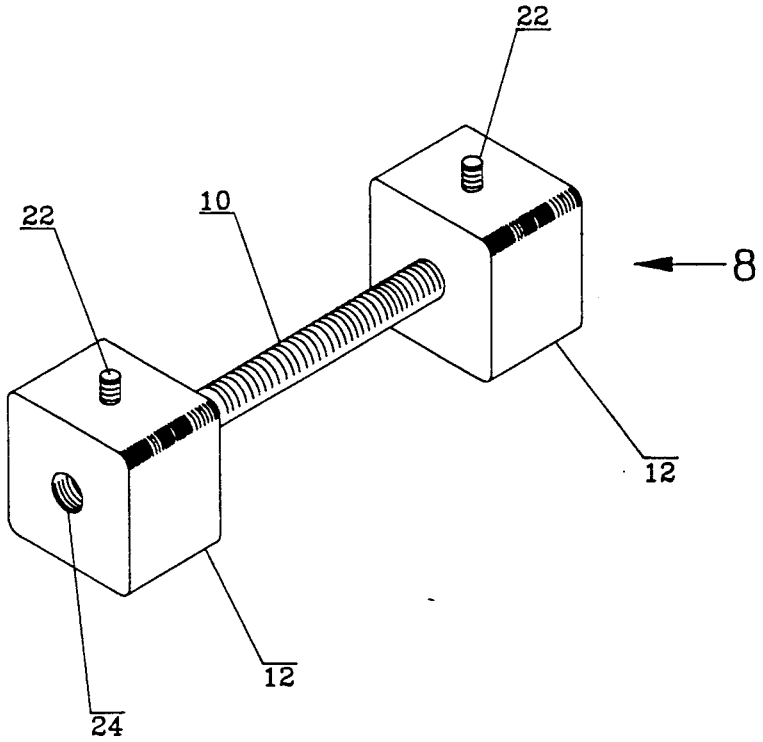
FIG. 3 is a three dimensional view showing the weighted ends and short handle of an interlocking dumbbell. Also depicted are two radially projecting male connectors and an axially recessed female connector.

An interlocking dumbbell exercise device 8 is depicted in FIGS. 1 and 3. The interlocking dumbbell 8 includes an axially extending short handle 10, along with a pair of solid dumbbell weights 12 mounted securely on each end of handle 10. Attached to and part of the exercise device 8 are two small cylindrical male connectors 22 and three small cylindrical female connectors 24 and 26, all of which can be made from cast iron or other suitable materials.

The solid single dumbbell weights 12 may be permanently affixed to each end of short handle 10 and the small cylindrical male connectors 22 may be permanently affixed to the solid single dumbbell weights 12. For this purpose, the male connectors 22 and the dumbbell weights 12 may be welded or molded in place. The small cylindrical female connectors 24 and 26 may be permanently recessed into the dumbbell weights 12 by drilling, boring, or molding. Alternately, the entire exercise device 8 may be produced by using a casting procedure.

Attention is next directed to the positions of the small cylindrical male connectors 22 and the small cylindrical female connectors 24 and 26 attached to and part of the solid dumbbell weights 12. One male connector 22 is centrally located on and projecting radially from an outer surface of each weight 12. One female connector 26 is extending radially and centrally recessed into an outer surface of each weight 12, and another female connector 24 is extending axially and centrally recessed into an outer end of the other weight 12.

In order to better facilitate the use of two interlocking dumbbells 8 while doing barbell type exercises, an independent intermediate short handle 28 has been designed as a horizontal connector. The intermediate short handle 28 may be made from metal, plastic, cast iron or other suitable material, and may be fashioned as a hollow tube or solid bar by any existing method of appropriate manufacture.

A weightlifter can now connect two identical exercise devices 8 together, either horizontally or vertically. The connection is engaged and maintained by holding the connected exercise devices 8 together with two hands while gripping the short handles 10 of the exercise devices 8 and inserting or positioning the respective male connectors 22 into the corresponding female connectors 26 for vertical connection, and by inserting or positioning the respective male connecting ends of the independent intermediate short handle 28 into the corresponding female connectors 24 for horizontal connection.

When, a weight training method, wherein a weightlifter using two hands, grasps two exercise devices 8, one in each hand, and holds the devices 8 together in connected fashion, and successively lifts the devices 8 maintaining them in connected fashion, and alternately when two exercise devices 8 are lifted successively in a unconnected fashion is practiced by a weightlifter, he or she will receive the benefit of better performance while doing a variety of barbell and dumbbell exercises using the same interlocking dumbbell exercise device.

I claim:

1. An exercise device comprising:

a pair of dumbbells, each including a pair of solid single dumbbell weights mounted on each end of an axially extending short handle, said weights having a predetermined weight;

first connecting means comprising at least one small cylindrical male connector being centrally located on and projecting radially from an outer surface of each weight and at least one small cylindrical female connector extending radially and centrally recessed into an outer surface of each weight, for connecting two dumbbells together vertically, said connection being engaged and maintained by holding said connected dumbbells together with two hands while gripping the short handles of the exercise devices;

Second connecting means comprising an intermediate short handle and at least one cylindrical female connector extending axially into one end of each dumbbell, for connecting two dumbbells together axially for use as a barbell.

* * * * *